US007543705B2

(12) United States Patent
Yourist

(10) Patent No.: US 7,543,705 B2
(45) Date of Patent: Jun. 9, 2009

(54) CONTAINER WITH ANTI-NESTING LEDGE

(75) Inventor: Sheldon Yourist, York, PA (US)

(73) Assignee: Graham Packaging Company, L.P., York, PA (US)

( * ) Notice: Subject to any disclaimer, the term of this patent is extended or adjusted under 35 U.S.C. 154(b) by 164 days.

(21) Appl. No.: 10/942,134

(22) Filed: Sep. 16, 2004

(65) Prior Publication Data

US 2006/0065568 A1 Mar. 30, 2006

(51) Int. Cl.
*B65D 21/00* (2006.01)
*B65D 85/62* (2006.01)

(52) U.S. Cl. ..... 206/519; 206/518; 220/669

(58) Field of Classification Search ..... 206/515, 206/514, 516, 519, 508, 518; 220/669, 675
See application file for complete search history.

(56) References Cited

U.S. PATENT DOCUMENTS

| | | | | | |
|---|---|---|---|---|---|
| 2,768,667 | A | * | 10/1956 | Hill | 206/518 |
| 2,819,557 | A | * | 1/1958 | Clark | 248/188.8 |
| 2,873,782 | A | * | 2/1959 | Gunn | 220/659 |
| 2,964,217 | A | * | 12/1960 | Mickler, Jr. | 206/506 |
| 3,580,475 | A | * | 5/1971 | Mobley | 206/509 |
| 3,954,178 | A | * | 5/1976 | Mason, Jr. | 206/508 |
| 4,231,476 | A | * | 11/1980 | Compton et al. | 206/519 |
| 4,303,174 | A | * | 12/1981 | Anderson | 220/263 |
| 4,306,664 | A | * | 12/1981 | Bawden | 220/675 |
| 4,826,039 | A | | 5/1989 | Landis | |
| 5,096,083 | A | * | 3/1992 | Shaw et al. | 220/304 |
| 5,373,958 | A | * | 12/1994 | Bokmiller | 220/284 |
| 5,533,623 | A | | 7/1996 | Fischer | |
| 5,752,602 | A | | 5/1998 | Ackermann et al. | |
| 5,775,483 | A | * | 7/1998 | Lown et al. | 206/508 |
| 5,791,509 | A | | 8/1998 | Rush et al. | |
| 6,269,967 | B1 | * | 8/2001 | de Vries | 220/669 |
| 6,581,772 | B2 | | 6/2003 | Noland | |
| 6,708,824 | B2 | | 3/2004 | Sahm, III | |
| 2002/0112983 | A1 | * | 8/2002 | Padovani | 206/519 |

FOREIGN PATENT DOCUMENTS

WO WO 9301991 A1 * 2/1993

* cited by examiner

*Primary Examiner*—Anthony D Stashick
*Assistant Examiner*—Niki M Eloshway
(74) *Attorney, Agent, or Firm*—Miles & Stockbridge P.C.; James T. Carmichael, Esq.; Michael A. Minter, Esq.

(57) ABSTRACT

A container with an anti-nesting ledge includes a substantially tubular sidewall defining a container interior. The sidewall has a first end and a second end and is tapered from the first end toward the second end to accept a like container within the container interior. A base connected to the second end to form a bottom of the container. The sidewall includes an indentation formed between the first end and the second end. The indentation extends from the sidewall into the container interior to form an interior ledge for supporting the like container in the container interior.

20 Claims, 6 Drawing Sheets

CONTAINER WITH ANTI-NESTING LEDGE

FIELD OF THE INVENTION

This invention relates generally to a container having a ledge to prevent sticking during nesting. More particularly, the invention is related to a blow molded container having an indentation in the side wall which forms an internal ledge to prevent sticking of a second container inside when the containers are stacked.

BACKGROUND OF THE INVENTION

Plastic containers have become particularly commonplace recently for packaging of consumer products due to ease of manufacture, the lightweight nature, ease of shipping, and low cost. Because many product manufacturers do not have facilities for forming containers on site, the containers must often be shipped from a production site to a product manufacturer for packaging of the product and later sale. Although the formed containers are light weight, the amount of space the containers consume during shipping is significant and may be the limiting factor in the quantity of containers that can be provided in a single shipment. For example, if containers are manufactured and placed on a pallet, there must be a divider in between layers of containers and the layers stacked one upon another, resulting in a large amount of empty space. As a result, the shipping of empty plastic containers can be cumbersome and relatively expensive.

One possible solution to this problem is to ship containers in a configuration wherein the containers are nested within one another. Using this methodology, significant space savings can be realized. However, particularly with plastic containers, when one container is placed within another, the containers can become wedged together and stick, being very difficult to separate. When this occurs, time must be taken to manually separate the containers from one another before a product can be packaged inside. This significantly increases the processing time for filling containers with a product for further shipment and sale. Additionally, when the containers become wedged one within another, it is difficult for automated machinery to separate the containers for filling, and the containers can need to be separated manually.

Several solutions have been attempted to overcome these problems in containers and other products. For example, U.S. Pat. No. 5,791,509 to Rush et al. discloses a stackable plastic cup lid with a groove formed in a first lid to accept a bottom portion of a second lid. Application of this methodology to a container is not very useful because the base of the container would rest upon the top of a second container, essentially stacking containers in an unnested fashion. Another solution has been proposed in U.S. Pat. No. 4,826,039 to Landis, which discloses nestable container lids with anti-nesting ribs on the interior of the lid. Use of such a structure in the base of a container would not be acceptable in many applications. First, the ribs are formed on the interior surface of a container, which may not be possible if the container is manufactured by a blow molding process. Second, the ribs are additional structural features which can add unnecessary weight to a container. Third, placement of ribs on the interior surface may not be acceptable in a situation where a product needs to be filled down to the bottom of the container, where the bottom of the container needs to remain flat for efficiently packaging a product, or where the ribs could damage a product or interior lining in which the product is packaged.

Another solution to preventing sticking in a nestable container is disclosed in U.S. Pat. No. 6,708,824 to Sahm, III.

This patent discloses tub-like containers which have anti-nesting ribs protruding radially around the exterior of the top portion of the container. The bottom of the anti-nesting rib rests upon the open rim of a similar container when the containers are nested. There are several drawbacks to this approach. First, unless specific tolerances are maintained to ensure that the ribs extend well below the top of the container, the containers could still become wedged and stuck together. The container disclosed in Sahm avoids this problem by having additional exterior ribs extending radially from the side wall of the container. This, however, disrupts the appearance of the outer portion of the container which can not be maintained as a smooth structure. Further, as described above with respect to Landis, this solution, with or without the additional exterior ribs in the side wall, requires the use of additional plastic material which can undesirably add weight to the container.

U.S. Pat. No. 5,752,602 to Ackermann et al. discloses a stackable and nestable tray which has columnar sections formed in the corners. These columnar sections extend into the internal portion of the tray and have an internal shelf on top. The base of one container can rest upon the interior shelf of a second container. Use of such a configuration significantly disrupts the regular shape of the interior and exterior of the container, which may not be acceptable for all applications. The columns molded into the edges of the container also take up significant interior space.

Other solutions to destacking or anti-nestable features are present in paperboard products. Such solutions are disclosed in, for example, U.S. Pat. No. 5,533,623 to Fischer and U.S. Pat. No. 6,581,772 to Noland. These solutions with paperboard products are generally less acceptable in the use of plastic products.

There thus remains a need for simple container designs which allow containers to be stackable or nested within one another, yet prevent unintended wedging or sticking of the containers to one another.

SUMMARY OF THE INVENTION

The present invention provides a solution to the aforementioned problems not available in the prior art. The solution is simple, economical and applicable to blow molded plastic containers in particular.

A container according to the invention includes a substantially tubular sidewall defining a container interior and having a first end and a second end. The sidewall includes an indentation between the first end and the second end and extending into the container interior. A base is connected to the second end of the sidewall to form a bottom of the container. The sidewall is tapered from the first end toward the second end in order to accept a like container within the container interior. The indentation includes a ledge for supporting the like container in the container interior. The inner wall of the indentation can be substantially parallel to the sidewall and the indentation can be substantially rectangular in a cross section taken parallel to the sidewall. The ledge can be relatively flat or curved, for example concave with respect to the interior of the container. The container can be made of a plastic material formed by a blow molding process. The sidewall has a substantially uniform thickness from the first end to the second end.

The container can have two indentations opposite one another. For example, the sidewall can have four substantially flat faces such that the container is substantially rectangular in cross-section with two indentations on faces that are opposite one another.

The base of the container can include a convex annular wall extending from the sidewall to a base wall. The convex annular wall can include a standing ring. At least a portion of the base wall can be substantially perpendicular to a central axis of the container. A cross section through the standing ring can be substantially square. The radius of curvature of the convex annular wall can be about the same as the radius of curvature of the concavity of the ledge.

The container is dimensioned such that a first container can nest within a second container with the base resting on the ledge in a way that the containers do not become wedged or stuck together. Accordingly, a distance from the central axis to the standing ring is greater than distance from the central axis to the ledge inner periphery. Further, the sidewall is tapered such that the largest exterior dimension of the sidewall proximal to the base is smaller than the interior dimension of the sidewall proximal to the indentation on a side of the indentation opposite the base.

The container can include a closure attached to the first end. The closure can have a recess for accepting the base of a like container.

The invention is also a stack of containers described above and a method of transporting containers by nesting one container inside another.

Further objectives and advantages, as well as the structure and function of preferred embodiments will become apparent from a consideration of the description, drawings, and examples.

BRIEF DESCRIPTION OF THE FIGURES

The foregoing and other features and advantages of the invention will be apparent from the following, more particular description of a preferred embodiment of the invention, as illustrated in the accompanying drawings wherein like reference numbers generally indicate identical, functionally similar, and/or structurally similar elements.

DETAILED DESCRIPTION OF THE INVENTION

Figure 1:
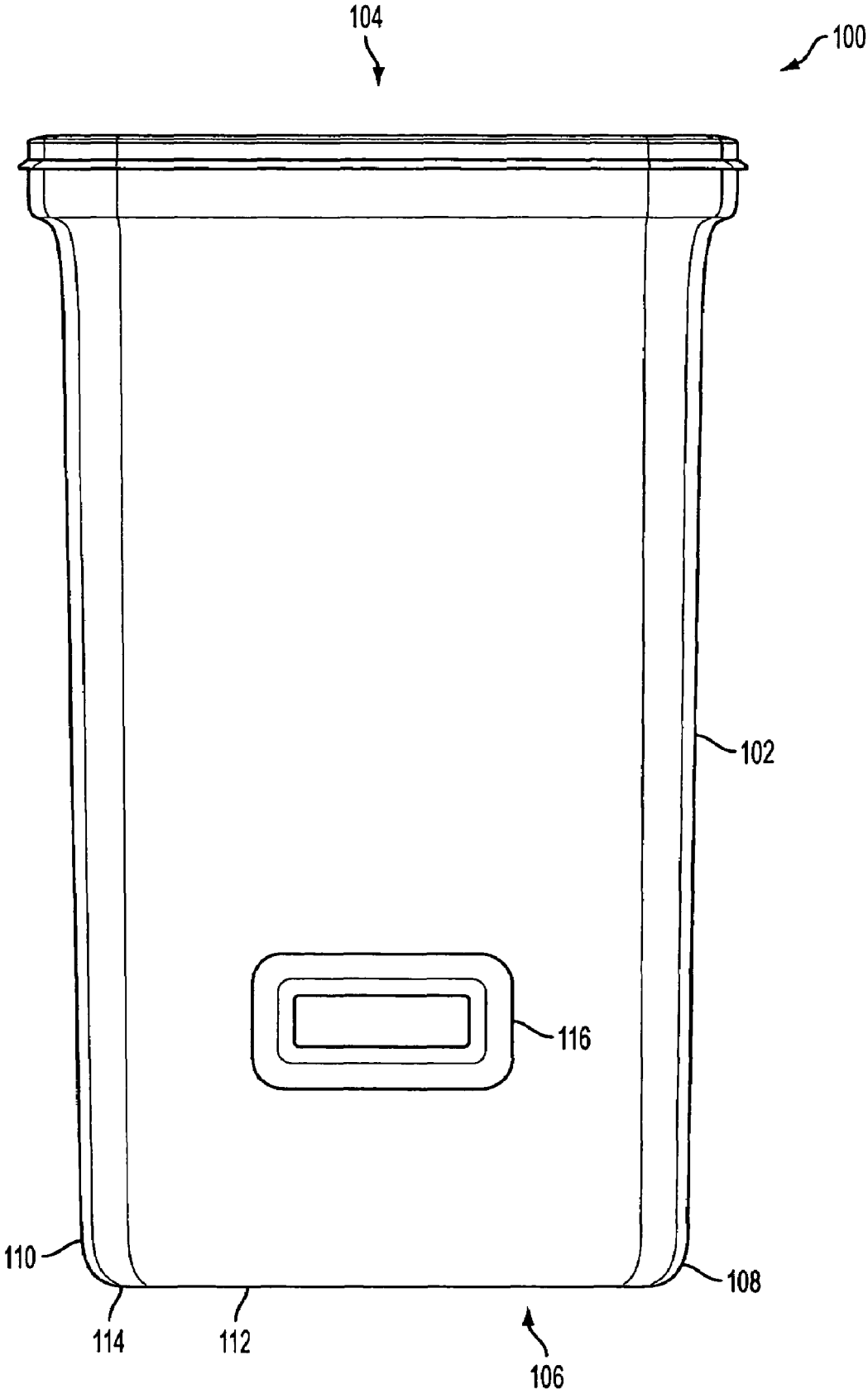
FIG. 1 is a side view of a container having an anti-nesting indentation according to the present invention.

Embodiments of the invention are discussed in detail below. In describing exemplary embodiments, specific terminology is employed for the sake of clarity. However, the invention is not intended to be limited to the specific terminology so selected. While exemplary embodiments are discussed, it should be understood that this is done for illustration purposes only. A person skilled in the relevant art will recognize that other components and configurations can be used without parting from the spirit and scope of the invention. All references cited herein are incorporated by reference as if each had been individually incorporated.

The present invention is a container, in particular a blow molded plastic container, with an indentation in the side wall. The indentation forms an anti-nesting ledge in the interior surface of the side wall upon which a like container can rest. As can be seen in the Figures, the container includes a substantially tubular side wall 102. The side wall 102 in the illustrated embodiment if formed with four faces so that it is substantially square in cross section with rounded, chamfered comers, as described in more detail below, although other geometric shapes are possible. For example, the container may be substantially round, including oval, triangular having three faces, rectangular, including square, with four faces, or may be any other geometric shape having four or more faces. As will be appreciated, comers in these polyhedral shapes are generally rounded. Containers can also have combinations of shapes, for example, a container can include flat panels between rounded panels. Two flat panels can be opposite one another.

The side wall 102 forms an exterior surface of the container 100 and defines an interior space. The side wall 102 has a first end 104 which can remain open in an empty container, and a second end 106 which can terminate in a bottom or closed end of the container. The second end 106 of the side wall 102 is connected to a base 108 which defines the closed end of the container. The side wall 102, while being substantially tubular, tapers inwardly towards the interior of the container in progressing from the first end 104 towards the second end 106. This tapering allows a first container 100 to accommodate a second container within the interior, as shown in FIG. 5 and described in more detail below. The base 108 can include a convex annular wall 110 which curves downward and inwardly from the sidewall 102 to a base wall 112. At least a portion of the base wall 112 can be substantially perpendicular to the central axis A of the container 100. (See FIG. 4) A portion of the convex annular wall 112 can form a standing ring 114 upon which the container 100 rests when stood on a surface. As will be appreciated by persons skilled in the art, the standing ring 114 may completely circumscribe the bottom portion of the container, such that the entire standing ring 114 rests upon a planar surface on which the container stands. In such a configuration, the base wall 112 can be recessed apart from the standing ring 114 such that it is situated somewhat upward from the base, i.e., in a direction toward the first end 104 of the side wall 102 and extending into the interior (See FIG. 2). Alternatively, the standing ring 114 can include projected regions upon which the container stands, the remainder of the standing ring 114 being more recessed towards the first end 104 of the container 100. Such a configuration is advantageous in that only several points form the contact region of the standing ring 114 so that, if the standing ring 114 is not perfectly planar, the container 100 is not subject to teetering or unevenness when placed on a flat surface. Such configurations are known in the art. Configurations useful in the present invention are not limited to those described herein, but other known configurations and configurations yet to be developed can be used.

A portion of the side wall 102 has an indentation 116 formed therein. The indentation 116 can be molded into the side wall 102 during a blow molding process used to form the container, or can be otherwise formed in a container after manufacture. For example, the indentation can be formed by impressing a form into the side of a container in an embossing or stamping process, or in a manner similar to a thermoforming process. In such a case, the indentation can be formed while the container is warm, soft and pliable, either as a result of the forming process or by reheating after the forming process, or the form can be warmed in order to make the plastic soft and pliable upon contact. The indentation 116 can be formed of a substantially uniform thickness throughout its entire extent, such that the thickness of the walls in the indentation 116 are substantially similar to the thickness of the side wall 102. As would be obvious to persons skilled in the art, some thinning of the wall forming the indentation or surrounding the indentation 116 is to be expected as a result of the blow-molding or other process by which the indentation is formed.

Figure 2:
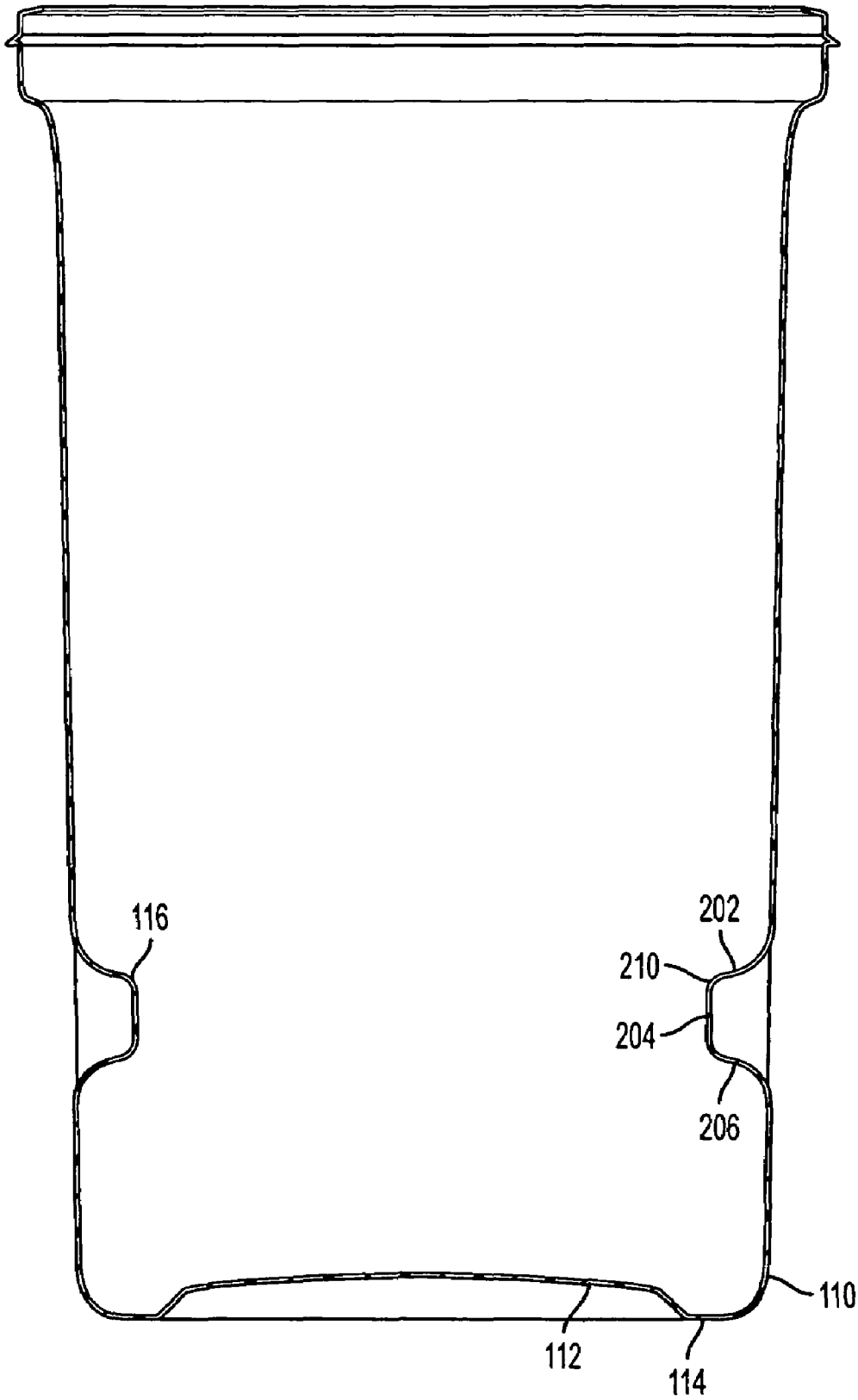
FIG. 2 is a cross-section of a container having two indentations according to an exemplary embodiment of the invention.
Figure 3:
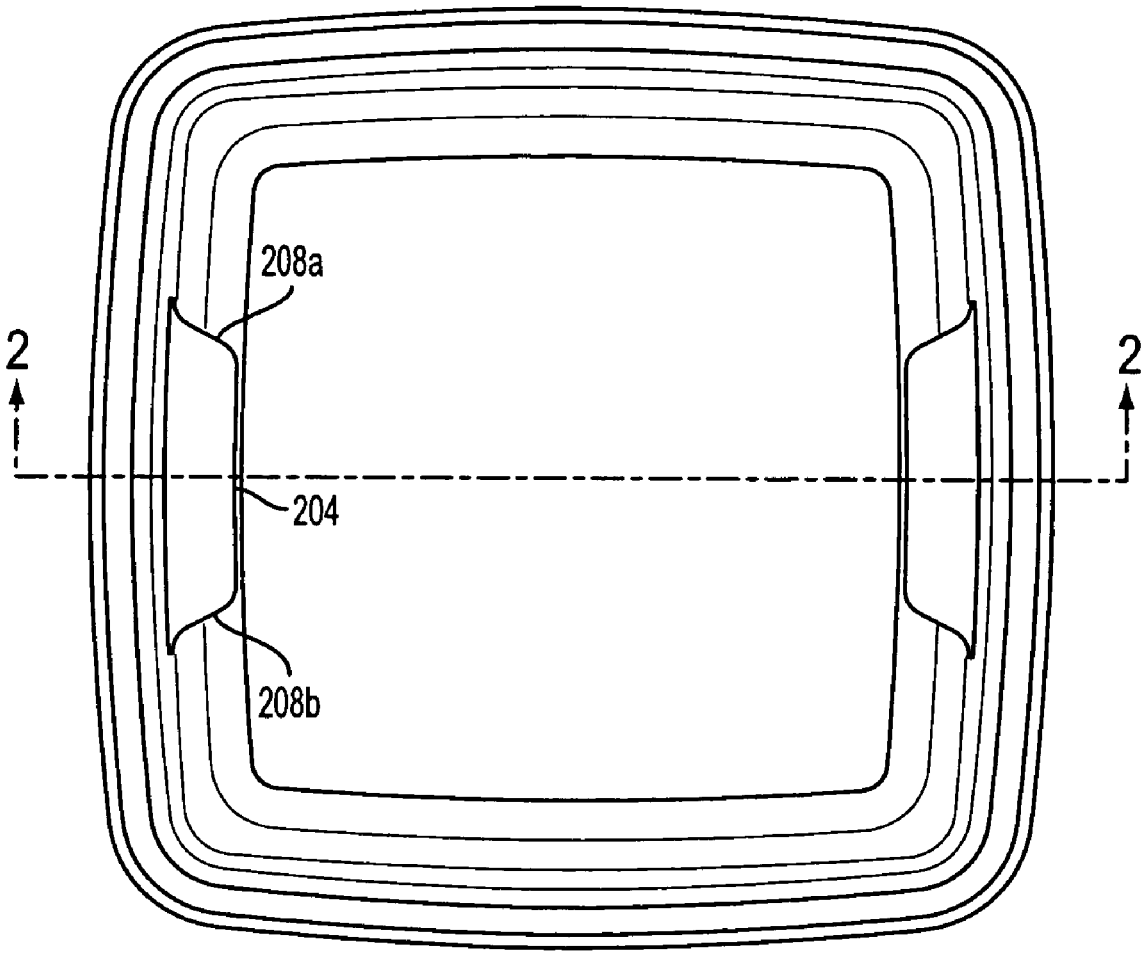
FIG. 3 is a top view of a container according to an exemplary embodiment of the invention.

FIG. 2 is a cross-section through the side wall 102 including the indentation 116, taken along the line 2-2 of FIG. 3. As can be seen, formation of the indentation 116 results in the formation of a ledge 202 on the interior portion of the container 100. The ledge 202 projects inward to the container in an amount sufficient to support a like container when a like container is placed within the container 100. The inwardly projecting ledge 202 can terminate in a region defined by an inner wall 204, which can be substantially parallel to the sidewall 102. The indentation 116 can have an inner periphery 210, where the ledge 202 tends toward the inner wall 204. In the configuration illustrated in FIG. 2, the inner periphery 210 can be considered as the region where the slope of the curved ledge 202 change its directions of curvature to move towards the inner wall 204. The lower portion of the indentation 116, i.e., on the side toward the base 108, includes a bottom wall 206 extending from the inner wall 204 to the side wall 102. FIG. 3 is a top view of the container 100, showing its interior. The side walls 208*a*, 208*b* of the indentation 116 extend from the inner wall 204 to the side wall 102. As can be seen in the exemplary embodiment illustrated in FIGS. 2 and 3, the ledge 202 can be concave in shape with respect to the interior of the container. The interior concavity of the ledge can be designed to approximately match the curvature of the convex annular wall 110 in the base of a similar container. Furthermore, FIGS. 2 and 3 show the bottom wall 206 and the end walls 208*a*, 208*b* as having a similar concavity as the ledge 202. As will be appreciated by persons skilled in the art, the edges of the indentation, including the ledge 202, bottom wall 206 and end walls 208*a*, 208*b*, are not limited to this particular configuration, but may be straight or have a different curvature. Additionally, it is not required that each of these edges be the same shape.

Figure 4:
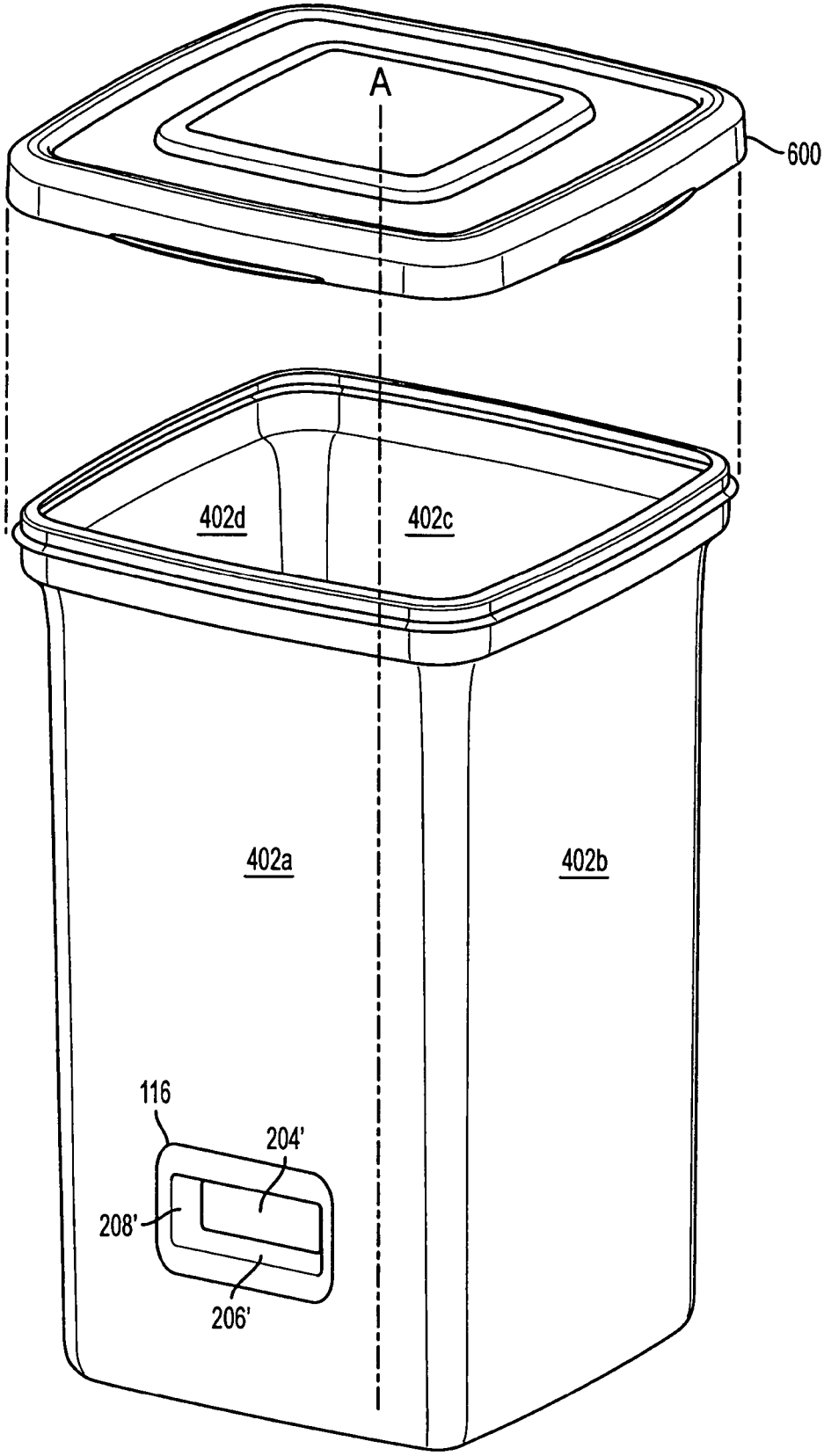
FIG. 4 is an exploded perspective view of a container and closure according to an exemplary embodiment of the present invention.
Figure 5:
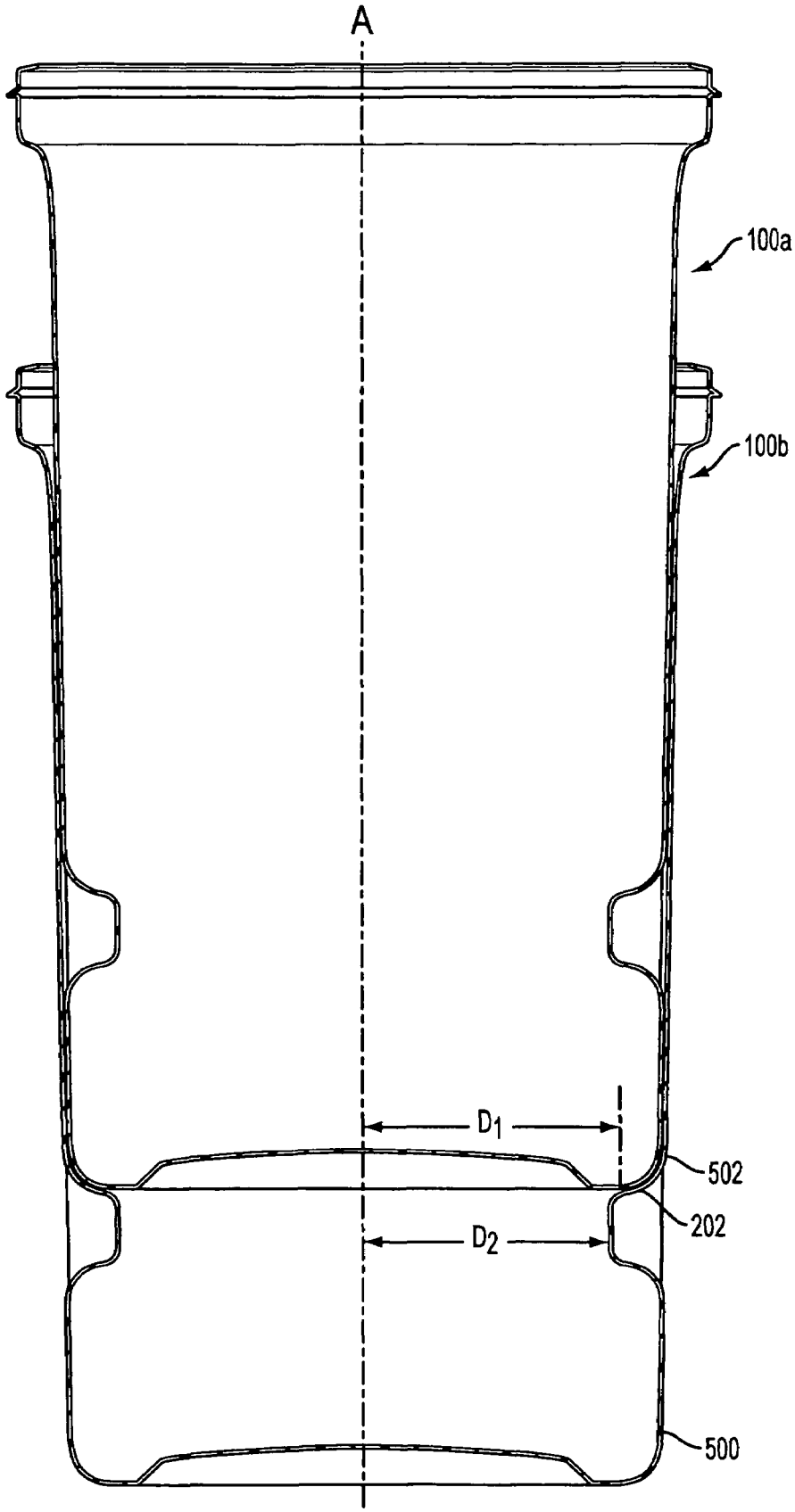
FIG. 5 is a cross-section through two containers stacked one within another according to an exemplary embodiment of the invention.

FIG. 4 is an exploded perspective view of an exemplary embodiment of a container according to the present invention, including a closure 600 that can be attached to the container. The side wall 102 in this exemplary embodiment comprises four faces formed by relatively flat panels 402*a*, 402*b*, 402*c*, 402*d*. The flat panels are arranged to form a substantially square structure in cross section with rounded comers, as seen in the top view of FIG. 3. The face defined by the flat panel 402*a* includes an indentation 116 as described above. In this exemplary embodiment of the invention, the face 402*c* includes a similar indentation positioned across from the indentation 116. In the illustrated embodiment, faces 402*b* and 402*d* do not contain indentations. As shown in FIG. 4, the indentation 116 includes an exterior surface 204' of the inner wall, an exterior surface 206' of the bottom wall and an exterior surface 208' of the end wall. As can be seen from the Figures, a cross-section taken through the indentation 116 in a plane parallel to the flat panel 402*a* would be substantially rectangular in shape with rounded comers. This substantially rectangular shape is maintained in any plane parallel to the face 402*a* and through the indentation 116; however, the perimeter of the rectangle defined by the indentation would be of different sizes depending upon the distance between the cross-sectional plane and the flat panel 402*a*. As mentioned above, the tubular side wall 112 can be of any shape including circular. When the side wall is, for example, circular, the cross-sectional plane through the indentation would be a plane parallel to a plane tangential to the side wall at the center point of the outermost extent of the indentation 116. Although the indentation of the illustrated embodiment has a rectangular cross-sectional shape, other shapes are equally acceptable including, for example, square and round.

FIG. 5 is a cross-section through a pair of stacked containers that includes an inner container 100*a* and an outer container 100*b*. The inner container 100*a* and outer container 100*b* are identical in structure. In order for the base of the inner container 100*a* to rest on the ledge 202 formed by the indentation 116 in the outer container 100*b*, the distance $D_1$ from a central axis A of the container to an outer portion of the standing ring 114 of container 100*a*, must be greater than the distance $D_2$ from the central axis A to the inner periphery 210 of the ledge. The outer portion of the standing ring 114, can be considered the point where the convex annuter wall 110 meets or merges into the standing ring 114. In the illustrated embodiment, approximately 75% of the inner container is within the outer container. In other embodiments, greater than 50% of the inner container is within the outer container.

As will be understood by persons skilled in the art, the sidewall 102 should be sufficiently tapered so that a container 100*a*, when nested inside a second container 100*b*, does not become wedged or stuck. For example, the largest exterior dimension of the sidewall in the lower region 500 of the container 100 proximal to the base 108 should be smaller than the smallest interior dimension in the upper region 502 of the sidewall 102, above and proximal to the indentation of the container, i.e., the smallest interior dimension of the sidewall proximal to the indentation on a side opposite the base 108. The exterior and interior dimensions referred to above can be, for example, the distance between the faces of a square design, or the diameter of a substantially circular design. Appropriate variations in the design of the container can assure that these dimensional requirements are met within the tolerances of a normal blow manufacturing process.

In an exemplary embodiment, the container is about 230-240 mm in height and has an overall width of about 145 mm, excluding the lid. This embodiment can have an indentation about 55 mm wide and about 36 mm in height, as measured from the outside of the container and including the blending radii, and extending about 10 mm into the interior of the container. The smallest vertical height of the indentation is about 15 mm. The top of the indentation upon which an inner container rests is about 60 mm above the bottom of the container. The width of the base taken at the lower end of the taper can be about 120 mm. A taper of about 1 degree throughout the length allows a container to nest within a second container over about 74% of its length, without becoming wedged or stuck, with the base of the inner container contacting about 35 mm of each ledge of the outer container.

FIG. 5 also shows a particular configuration wherein the radius of curvature of the concavity of the ledge 202 is similar to the radius of curvature of the convex annular wall 110. Although this matching of curvatures is shown for exemplary purposes, so long as the dimensional requirements above are met and the ledge is designed with sufficient concavity or structure to accommodate the convex annular wall 110 and prevent sticking, the containers are suitable. For ledges having other shapes, the base of the container can similarly be formed with a complementary shape. However, the shape of the ledge and the base can be different.

The present invention advantageously overcomes some of the deficiencies in prior art solutions to nestable containers. For example, the feature, i.e. the indentation 116, that prevents sticking of the containers is formed without significantly increasing the amount of plastic used to form the container. Further, the structural differences in the interior of the container are minimized. There are no sharp edges that are created when using a rib type of structure. The anti-nesting configuration is limited to a minimal number of positions in the container so that the interior dimensions of the container are not adversely affected. Additionally, the container's indentations according to the present invention can be readily manufactured by blow molding methods. As will be appreciated by persons skilled in the art, the indentations would typically be formed in a mold half and not along the parting line. Thus, when mold halves separate for release of the container during the blow molding process, any structural features in the mold would be sufficiently separated from the side walls to allow release of the containers.

Using the present invention, containers can be transported in a nested configuration, yet remain easily separable for handling by automated packaging equipment. The nested containers do not stick together and manual separation of the containers is not required. Using configurations similar to those shown in the illustrated embodiment, space savings of up to 90%, and typically in the range of 75-80%, can be achieved for shipping of containers. Thus, the present invention represents a simple container configuration that can be easily manufactured and allows containers to nest within one another without becoming stuck. The containers are readily manufactured using, for example, blow molding processes well known in the art.

Figure 6:
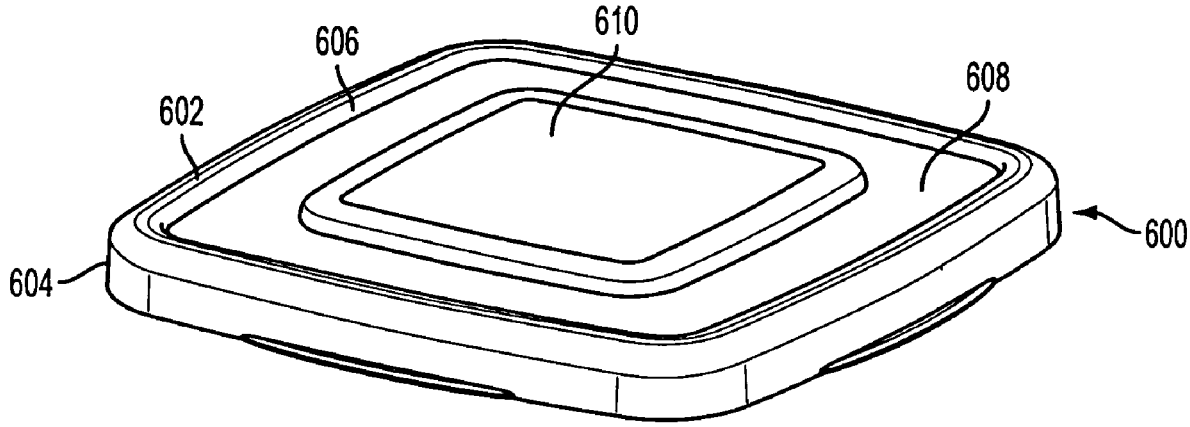
FIG. 6 is a top perspective view of a closure which can be used for sealing the opened end of a container according to the invention.

FIG. 6 is a perspective view of a closure 600 that can be used for capping the open end of a container 100 manufactured according to the present invention. The closure 600 includes an elevated rim 602 with a skirt 604 extending downward on the exterior portion of the rim 602, and an inner rim wall 606 extending downward from the interior portion of the rim 602 to a recess 608. Although the rim 602 is shown as being curvilinear between the skirt 604 and inner rim wall 606, a more flattened structure can be used. The inner surface of the skirt 604, rim 602, and inner rim wall 606 form a channel into which the top of the container 100 can be inserted for sealing. The interior surface of the skirt 604 can contain locking tabs for locking onto complementary projections in the first end 104 of the container 100. The formation of such locking tabs and projections is well known in the art.

The inner portion of the closure 600 can also include a central push up 610 projecting upwards from the recess 608. As described above and illustrated in the cross-section of FIG. 2, the base wall 112 of the container 100 can be recessed towards the interior of the container apart from the standing ring 114. In a container with a recessed base wall, the central push up 610 of the closure 600 can fit within the recessed portion of the base wall 112. Thus, the standing ring of a container 114 can rest within the recess 608 while the central push up 610 is in the recess of the base wall 112. Such a configuration adds further stability when a container is stacked upon a container to which the closure 600 is attached, for example after the containers are filled.

The embodiments illustrated and discussed in the specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

What is claimed is:

1. A container comprising:

a substantially tubular sidewall defining a container interior and having a first end; and a second end;

an indentation formed in said sidewall between the first end and the second end and extending from the sidewall into the container interior, wherein the width of the indentation is less than the width of the container sidewall; and a base connected to the second end to form a bottom of the container;

wherein the sidewall is tapered from the first end toward the second end to accept a like container within the container interior;

wherein the indentation comprises a ledge for supporting the like container in the container interior, an inner wall disposed at an interior terminus of the ledge, a bottom wall disposed opposite the ledge and extending from the inner wall to the sidewall, and two end walls extending in the widthwise direction of the indentation, each end wall extending, respectively, from opposing ends of the inner wall to the sidewall;

wherein the base comprises an annular wall extending from the sidewall to a base wall; and wherein the annular wall has a curvature substantially similar to a curvature of an arcuate portion of the ledge proximal the side wall.

2. The container of claim 1, wherein the inner wall is substantially parallel to the sidewall.

3. The container of claim 1, wherein the indentation is substantially rectangular in a cross section taken parallel to the sidewall.

4. The container of claim 1, wherein the ledge is concave with respect to the interior of the container.

5. The container of claim 1, having two indentations opposite one another.

6. The container of claim 1, wherein the sidewall comprises four substantially flat faces such that the container is substantially rectangular in cross-section.

7. The container of claim 6, having two indentations on faces that are opposite one another.

8. The container of claim 1, wherein the container comprises a plastic material and is formed by a blow molding process.

9. The container of claim 1, wherein the sidewall has a substantially uniform thickness from the first end to the second end.

10. The container of claim 1, wherein the annular wall is convex.

11. The container of claim 10, wherein the convex annular wall comprises a standing ring.

12. The container of claim 11, wherein a distance from a central axis of the container to the standing ring is greater than a distance from the central axis to a ledge inner periphery.

13. The container of claim 11, wherein a cross section thorough the standing ring is substantially square.

14. The container of claim 10, wherein at least a portion of said base wall is substantially perpendicular to a central axis of the container.

15. The container of claim 1, further comprising a closure attached to the first end.

16. The container of claim 15, said closure comprising a recess for accepting the base of a like container.

17. A stack of containers, comprising a plurality of containers, each container comprising:

a substantially tubular sidewall defining a container interior and having a first end; and a second end;

an indentation formed in said sidewall between the first end and the second end, wherein the width of the indentation is less than the width of the container sidewall; and said indentation extends from the sidewall into the container interior and comprises a ledge in the container interior, an inner wall disposed at an interior terminus of the ledge, a bottom wall disposed opposite the ledge and extending from the inner wall to the sidewall, and two end walls extending in the widthwise direction of the indentation, each end wall extending, respectively, from opposing ends of the inner wall to the sidewall; and a base connected to the second end to form a bottom of the container;

wherein the sidewall is tapered from the first end toward the second end;

wherein the base comprises an annular wall extending from the sidewall to a base wall;

wherein the annular wall has a curvature substantially similar to a curvature of an arcuate portion of the ledge proximal the side wall; and wherein a first one of said containers is nested within a second one of said containers; the ledge of the second container is in contact with the base of the first container; and a portion of the annular wall of the first container is nested within the arcuate portion of the ledge of the second container.

18. The stack of containers of claim 17, wherein the sidewall is tapered such that the largest exterior dimension of the sidewall proximal to the base is smaller than the interior dimension of the sidewall proximal to the indentation on a side of the indentation opposite the base.

19. The stack of containers of claim 17, wherein the first container is nested within the second container without significant wedging or stacking of the containers.

20. The stack of containers of claim 17, wherein the annular wall is convex and the ledge is concave with respect to the interior of the container, wherein the radius of curvature of the convex annular wall is about the same as the radius of curvature of the concavity of the ledge.

* * * * *

UNITED STATES PATENT AND TRADEMARK OFFICE

CERTIFICATE OF CORRECTION

PATENT NO. : 7,543,705 B2
APPLICATION NO. : 10/942134
DATED : June 9, 2009
INVENTOR(S) : Sheldon Yourist It is certified that error appears in the above-identified patent and that said Letters Patent is hereby corrected as shown below:

Column 8 – Line 34, replace "inner wall is" with -- indentation comprises an inner wall that --.

Column 8 – Line 54, replace "annular wall is convex" with -- base comprises a convex annular wall extending from the sidewall to a base wall --.

Column 10 – Line 19, insert -- base comprises a convex -- after "wherein the".

Column 10 – Line 19, delete "is convex".

Signed and Sealed this

Twentieth Day of October, 2009

David J. Kappos

David J. Kappos
*Director of the United States Patent and Trademark Office*